US005713084A

United States Patent [19]

Greco

[11] Patent Number: 5,713,084

[45] Date of Patent: Feb. 3, 1998

[54] TOILET SEAT LIFT MECHANISM

[76] Inventor: Robert M. Greco, 2 Pear St., Schuylkill Haven, Pa. 17972

[21] Appl. No.: 510,664

[22] Filed: Aug. 3, 1995

[51] Int. Cl.[6] ..... A47K 13/10

[52] U.S. Cl. ..... 4/246.1

[58] Field of Search ..... 4/246.1–246.5

[56] References Cited

U.S. PATENT DOCUMENTS

| | | | |
|---|---|---|---|
| 2,318,518 | 5/1943 | Oppener | 4/246.1 |
| 2,473,082 | 6/1949 | Warner . | |
| 4,426,743 | 1/1984 | Seabrooke . | |
| 4,438,535 | 3/1984 | Paredes . | |
| 5,461,733 | 10/1995 | McKee | 4/246.1 |
| 5,487,192 | 1/1996 | Hodges | 4/246.3 |

FOREIGN PATENT DOCUMENTS

| | | |
|---|---|---|
| 708552 | 7/1931 | France . |
| 658023 | 10/1951 | United Kingdom . |

*Primary Examiner*—Charles E. Phillips
*Attorney, Agent, or Firm*—Richard C. Litman

[57] ABSTRACT

A lift mechanism which attaches to the rear edge of a toilet bowl including a lever which pivots at a base in a rotational plane parallel to that of the target element, such as the toilet seat. The lever may be flexed so as to permit insertion of a tang between the toilet seat and the bowl and includes a stabilizer which, in combination with the tang, complementarily receives the element throughout articulating the element to a raised position. The user is spared having to physically contact the seat. The toilet seat lid may be articulated alone or with the lid.

20 Claims, 9 Drawing Sheets

TOILET SEAT LIFT MECHANISM

BACKGROUND OF THE INVENTION

1. Field of the Invention

This invention relates to lift mechanisms for toilet seats.

2. Description of the Prior Art

The advent of deadly diseases which may be transmitted via bodily fluids has created reluctance in some to use public rest rooms. Weary users are rue to manipulate toilet seats within public rest rooms for fear of coming into contact with bodily fluids of unknown origin. An unfortunate consequence of this trepidation is untidiness, thus promoting an unhealthy environment.

The patent literature contains some inventions which attempt to remedy this problem, however, none including features of the present invention.

For example, U.S. Pat. No. 2,473,082 issued Jun. 14, 1949 to Robert B. Warner describes a toilet seat lift mechanism including a base mounted to the rear edge of the toilet seat to which two levers are mounted. Each lever pivots about a central axis parallel to the pivotal axis of the toilet seat. One of two lifting attachments is mounted to the seat. The other lifting attachment is mounted to the lid. One of two levers is slidingly received by the attachment mounted to the seat. The other lever is slidingly received by the attachment mounted to the lid. Warner's invention necessitates two levers, whereas the present invention may accomplish the same functions of raising the lid as well as the seat with the same levered mechanism.

U.S. Pat. No. 4,426,743 issued Jan. 24, 1984 to Allen B. Seabrooke describes a toilet seat lift mechanism including a foot pedal. The foot pedal is connected to a lever mounted to the seat by a series of cables, rollers and levers. Depressing the foot pedal induces tension in the cable which is transferred to the lever which raises the seat. As in the case of Warner's invention, Seabrooke's invention necessitates mounting attachments on the seat and lid. Seabrooke's device also involves complex mechanisms including cables which may fail or require periodic adjustment, of which the present invention has none.

U.S. Pat. No. 4,438,535 issued Mar. 27, 1984 to Candelario Paredes describes a biasing mechanism which promotes simultaneous manipulation of a toilet seat with the lid. The invention further includes a magnet arrangement between the lid and toilet tank such that the lid is maintained in the raised position with force sufficient to overcome the bias between the seat and lid; the user may pull the seat down into the lowered position while the magnet on the toilet tank retains the lid in the raised position. Paredes' invention does not include a means to manipulate the lid or seat.

British Patent No. 658,023 published Oct. 3, 1951 and issued to Stanislav Zivotsky describes a toilet seat lift mechanism including an attachment mounted to the toilet seat. The attachment includes a horizontal dowel which receives a weighted handle that pivots thereabout. The weight of the handle promotes the handle to remain in an upright position regardless of the seat attitude. Zivotsky's invention, similar to the other references discussed above, necessitates mounting an attachment to the seat and to the lid.

French Patent No. 708,552 published Jul. 25, 1931 and issued to M. Léonce Febvrel describes a toilet seat lift mechanism similar to Seabrooke's invention including a foot pedal. Depressing the foot pedal induces tension in the cable which actuates a lever and raises the seat. Febvrel's invention necessitates specific designation of the device for each pivotally mounted element of the toilet.

None of the above references, taken alone or in combination, are seen as teaching or suggesting the presently claimed toilet seat lift mechanism.

SUMMARY OF THE INVENTION

The present invention is a seat lift mechanism having a base which attaches to the rear edge of a toilet bowl. A housing mounts to the base. A semi-rigid lever is received in the housing and pivots therein. The lever pivots in a rotational plane generally parallel to that of the toilet seat.

A tang is disposed at the distal end of the lever. The tang is dimensioned and configured to be received between a toilet bowl and seat. The tang should also be dimensioned and configured to be received between a toilet seat and lid. The tang includes a stabilizer which, in combination with the tang, firmly traps the element seized. The tang and stabilizer maintain complementary contact with the element throughout its articulation from a lowered to a raised position, or vice versa.

Flexing the lever permits the user to insert the tang between the bowl and seat, or seat and lid. Having seized the seat, the user may urge it into a raised position without the user having to physically contact the seat.

In consideration of the above, an object of the invention is to provide a toilet seat and lid lifting mechanism which is easily installed and maintained.

Another object of the invention is to provide a toilet seat and lid lifting mechanism which provides for lifting the seat or lid with a singular structure rather than multiple members designated for each target element.

A further object of the invention is to provide a toilet seat and lid lifting mechanism which promotes a hygienically superior arrangement to achieve raising and lowering of the seat or lid.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
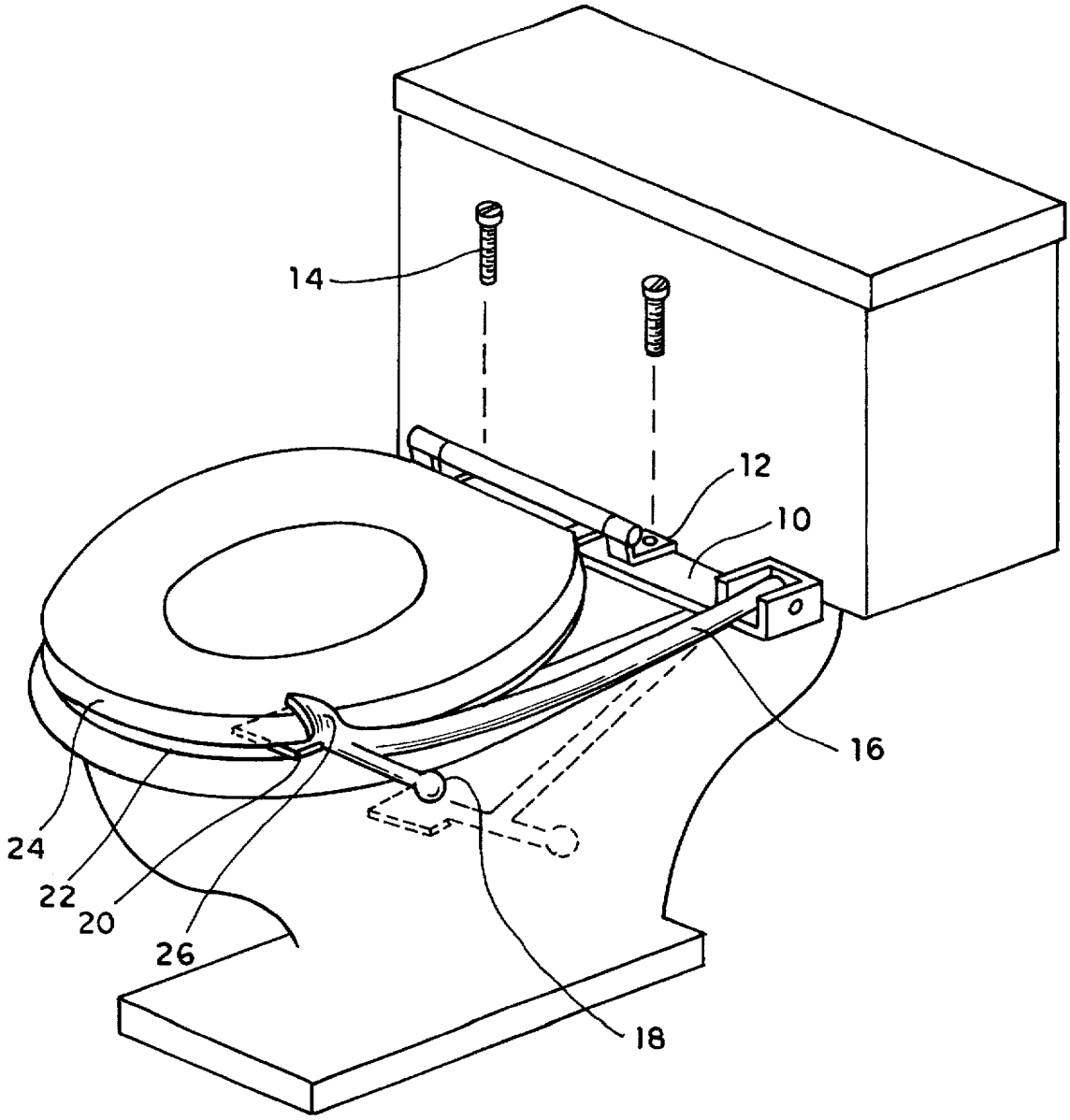
FIG. 1 is an environmental perspective view of an embodiment of the invention installed on a conventional toilet with the seat shown in the lowered position.

Referring to FIG. 1, the invention has a base 10 which mounts to the back edge of the rim of the toilet. Base 10 is secured to the toilet under the toilet seat mounts 12 by conventional fasteners 14. Although the invention is shown having base 10 separate from the toilet seat mounts 12, an alternative (not shown) may integrate seat mounts 12 and base 10.

A lever 16 may be formed from any suitable and somewhat pliable material selected from resilient synthetic polymers including, but not limited to, natural and synthetic rubbers, elastomers, polyurethanes, low-density polyethylenes and the like. A knobbed grip 18 is disposed at one end of lever 16, but may be disposed anywhere on lever 16.

A tang 20, dimensioned and configured to be received interposed between the toilet bowl 22 and seat 24, is disposed at the end of lever 16. Tang 20 also is dimensioned and configured to be received interposed between the toilet seat 24 and lid (not shown). Tang 20 complementarily receives the bottom of the seat 24 or lid (not shown). A stabilizer 26, shown integral with tang 20, complementarily receives the top of the seat 24 or lid (not shown). Together, tang 20 and stabilizer 22 firmly and complementarily trap and retain the seat 24 or lid (not shown) throughout rotation from a lowered to a raised position. The user enjoys the ability to positively seize the toilet seat 24 or lid (not shown) without having to physically contact either to articulate either. The user also avoids the risk of a precipitous release which may cause damage to the toilet, seat 24 or lid (not shown).

Figure 2:
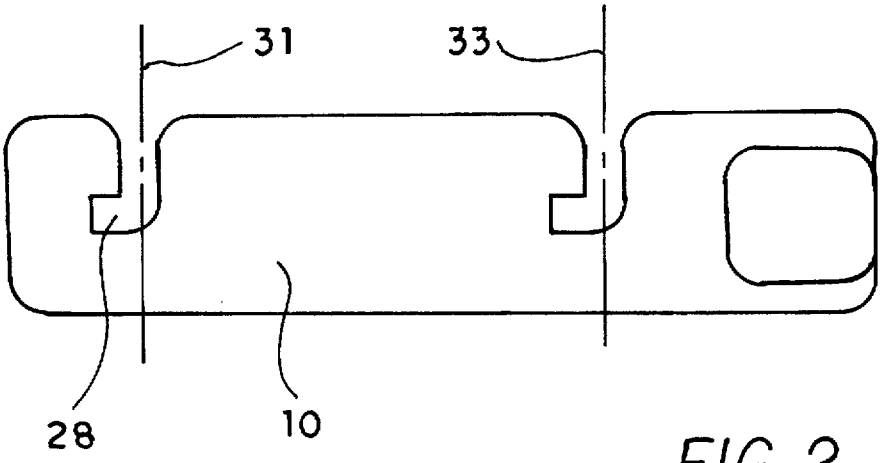
FIG. 2 is a top plan view of an embodiment of the base.

Referring to FIG. 2, base 10 is shown having J-shaped grooves 28. The stems 29 of each J-shaped groove 28 are disposed along lines 31 and 33 which are generally parallel. The grooves 28 permit ready installation of the base 10 under the toilet seat 24 mounts 12 by merely loosening fasteners 14, rather than having to remove fasteners 14 entirely. Base 10 is shown oriented for a right-handed user, however, is readily reversible to accommodate a left-handed user.

Figure 3:
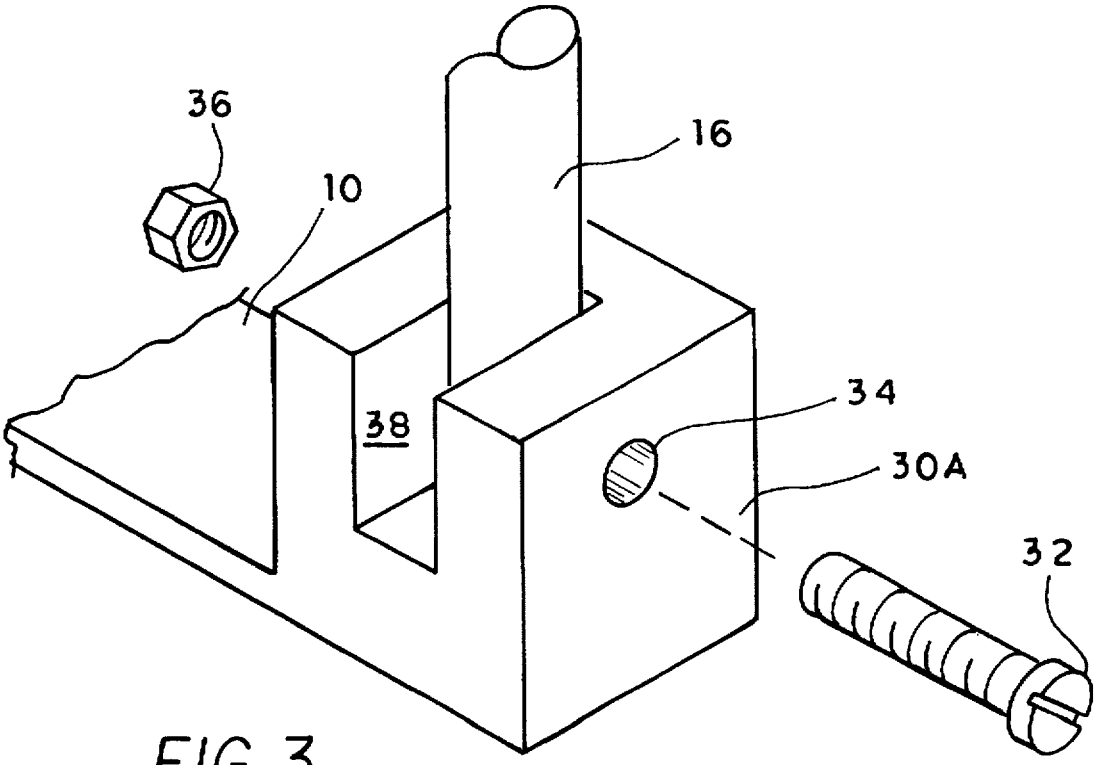
FIG. 3 is an exploded, fragmentary perspective view drawn to an enlarged scale of an embodiment of a housing-lever arrangement.

Referring to FIG. 3, the invention includes a housing **30*a* which is integral with base 10. A threaded bolt 32 or pin (not shown) is received in an aperture 34 and pivotally secures lever 16 to housing 30*a*. Retention nut 36 or clip (not shown) threadingly engages bolt 32. A clip (not shown) may be used instead of nut 36 to secure bolt 32. Lever 16 freely rotates through a slot 38 during raising and lowering of the seat 24 or lid (not shown). When in the raised position, the lever 16 frictionally engages with the housing 30*a*** and remains upright.

Figure 4:
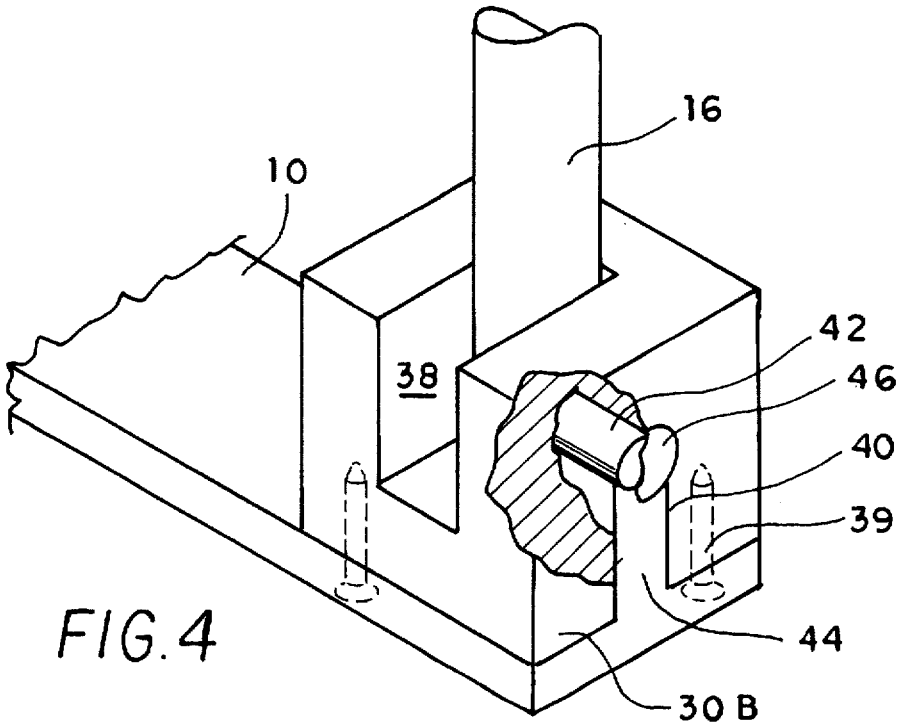
FIG. 4 is a fragmentary perspective view partially in section of another embodiment of a housing-lever arrangement.

Referring to FIG. 4, another embodiment of the invention includes a housing **30*b* fastened to base 10 with fasteners (e.g., screws) 39. Housing 30*b* has a slot 40 through which an axle 42 is installed. An axle support 44, shown molded integral with base 10, holds axle 42 in position within slot 40. Axle support 44** may be a separate part.

Axle 42 may be integral with lever 16 or constructed to interengage with lever 16. Axle 42 is shown having decorative end caps 46.

Figure 5:
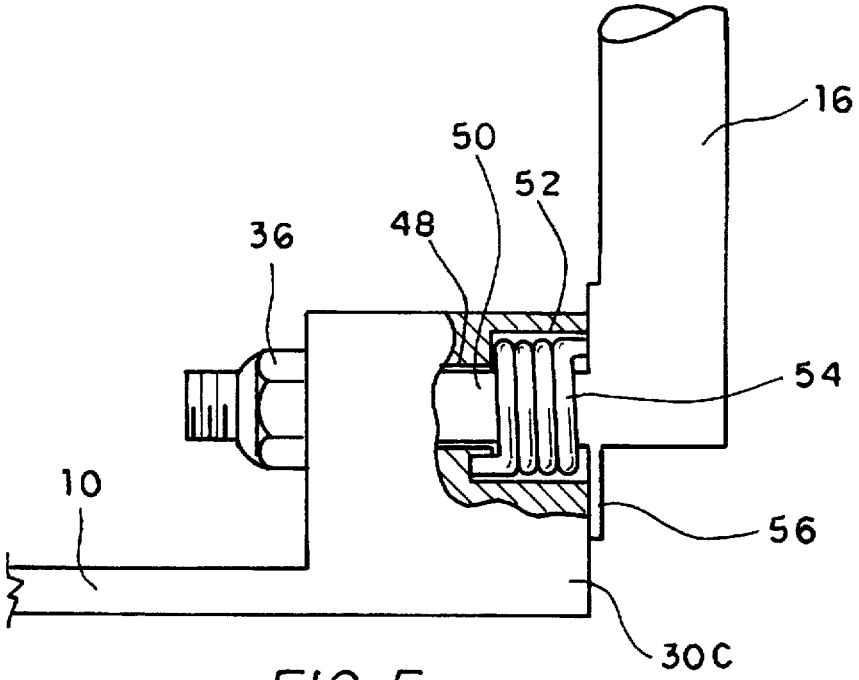
FIG. 5 is a fragmentary perspective view partially in section showing yet another embodiment of a housing-lever arrangement.
Figure 11:
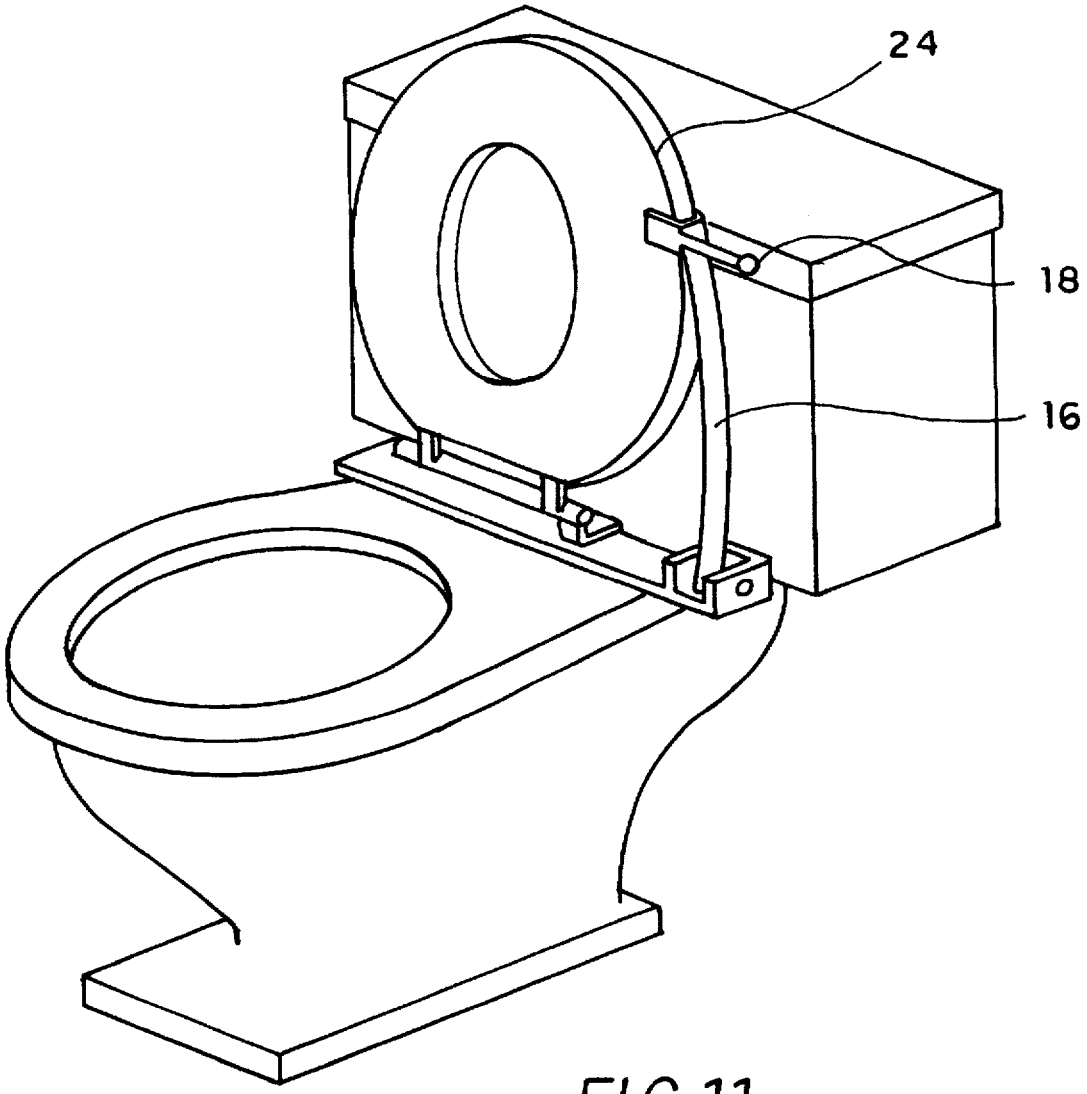
FIG. 11 is an environmental perspective view of an embodiment of the invention installed on a conventional toilet, with the toilet seat moved to a raised position.

Referring to FIG. 5, another embodiment of the invention includes a housing **30*c* integral with base 10. Housing 30*c* has a bore 48 dimensioned and configured to slidingly receive a shaft 50. Counterbore 52, in registration with a bore 48, is dimensioned and configured to receive a coil spring 54. Shaft 50 has an enlarged section 56 which retains an end of a spring 54. The other end of spring 54 is retained in housing 30*c*. Spring 54 biases lever 16 toward a raised position, as is shown in FIG. 11. Retention nut 36 and enlarged shaft section 56 laterally position shaft 50 in housing 30*c*. A clip (not shown) may also hold shaft 50** in place.

Figure 6:
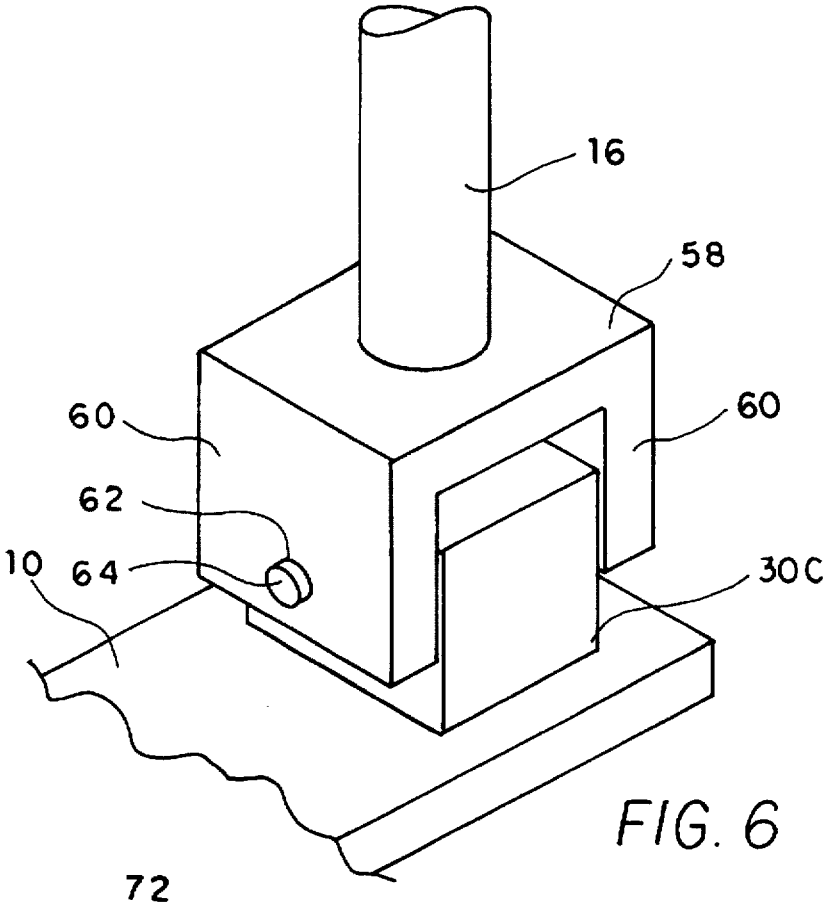
FIG. 6 is a fragmentary perspective view showing a further embodiment of a housing-lever arrangement.

Referring to FIG. 6, another embodiment of the invention is shown including a housing **30*d* integral with base 10. Lever 16 is fixed to a U-shaped bracket 58. The legs 60 of bracket 58 are generally parallel to each other. Each leg has similarly-sized, axial bores 62 in registration for receiving an axle 64. Housing 30*d* has an axial bore (not shown) similarly-sized and in registration with axial bores 62 for receiving axle 64**.

Figure 7:
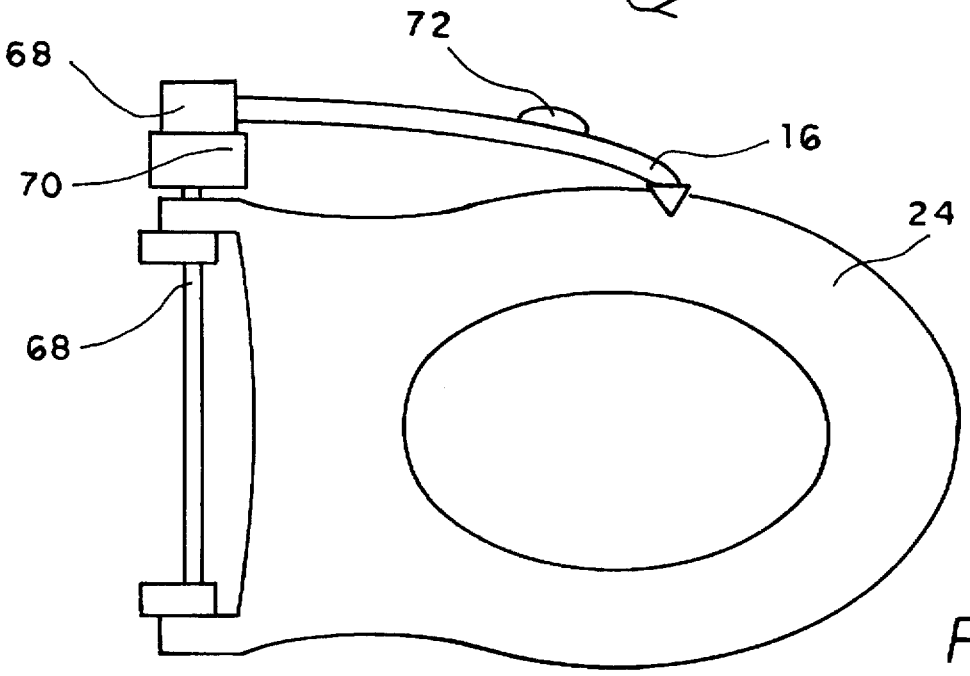
FIG. 7 is a top plan view of an additional embodiment of a housing-lever arrangement.

Referring to FIG. 7, yet another embodiment of the invention is shown having no base-mounted housing. Lever 16 is connected to a sleeve 66. Sleeve 66 frictionally engages an axle 68 that also serves to pivotally secure the toilet seat 24 to the toilet. Coil spring 70 biases lever 16 toward a raised position with respect to the toilet, as shown in FIG. 11. Lever 16 is shown having a ridge 72, rather than a knob 18, disposed generally in the middle of lever 16.

Figure 8:
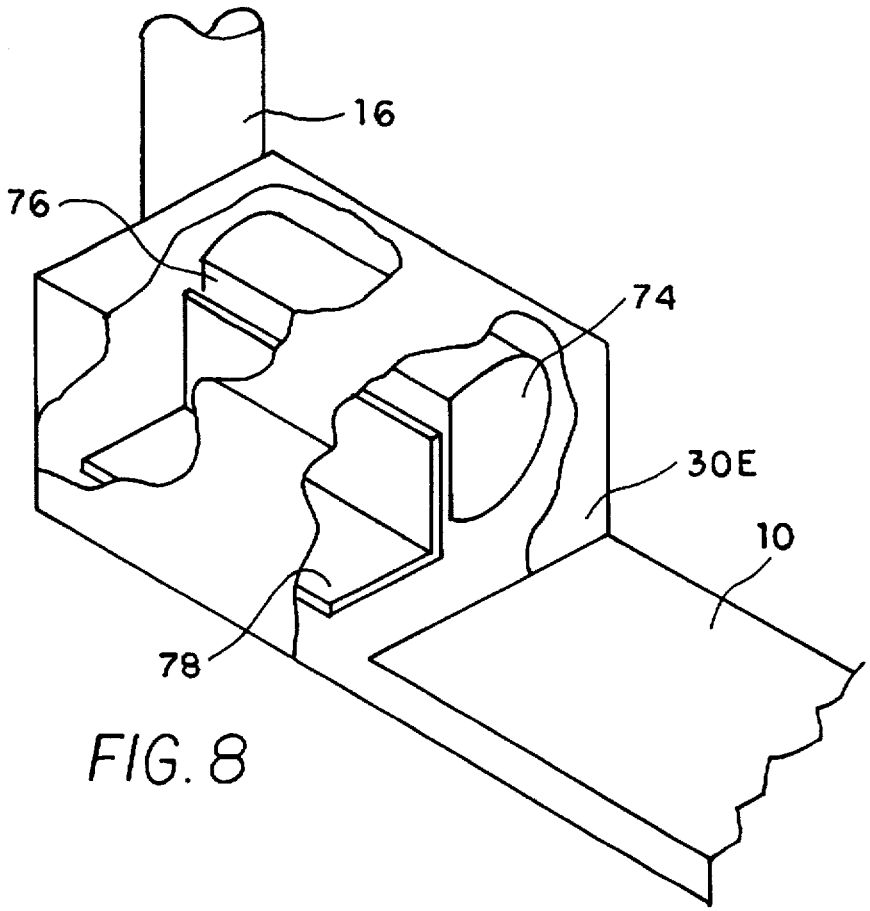
FIG. 8 is a fragmentary perspective view partially in section showing another embodiment of a housing-lever arrangement.

Referring to FIG. 8, an additional embodiment of the invention is shown including a housing **30*e* mounted to base 10 with fasteners (not shown). Lever 16 is connected to one end of a multiple-sectioned axle 74. The other end of axle 74 has an end cap (not shown) similar to end cap 46 as shown in FIG. 4. The middle section 76 of axle 74 has a semi-circular section profile. When lever 16 is urged to a lowered position, axle 74 rotates counter-clockwise and compresses an L-shaped spring 78. Spring 78 biases axle 74 against housing 30*e* and, therefore, lever 16** toward the raised position.

Figure 9:
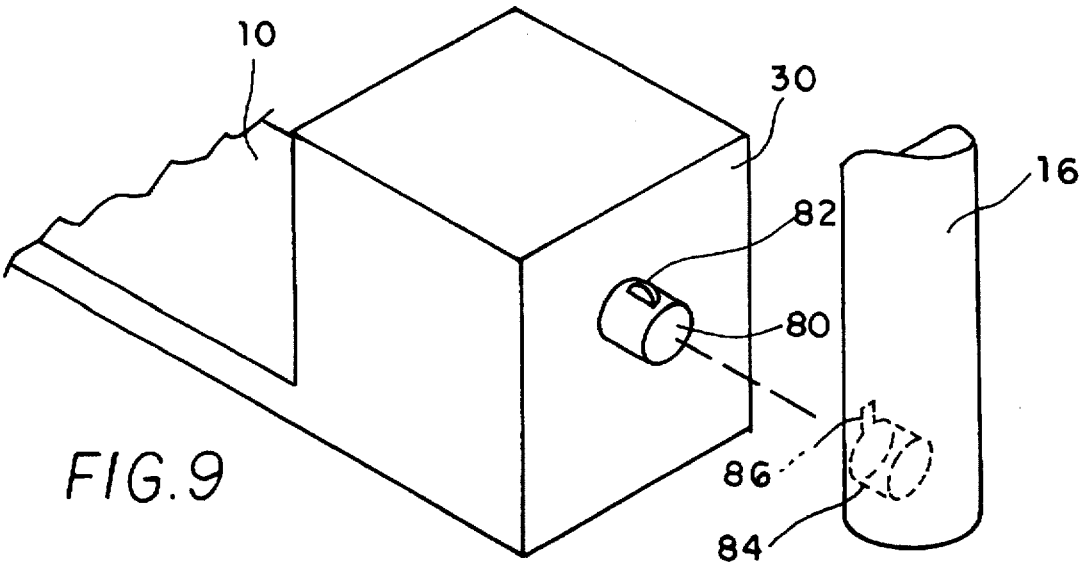
FIG. 9 is a fragmentary perspective view of yet another embodiment of a housing-lever arrangement.

Referring to FIG. 9, yet another embodiment of the invention is shown including housing **30*f* integral with base 10. Housing 30*f* contains a sealed axle 80 including a key 82. Lever 16 has a cylindrical bore 84 and slot 86 which receive axle 80 and key 82, respectively. Lever 16 is detachable from axle 80** permitting ready removal or installation for cleaning or shipping, respectively.

Figure 10A:
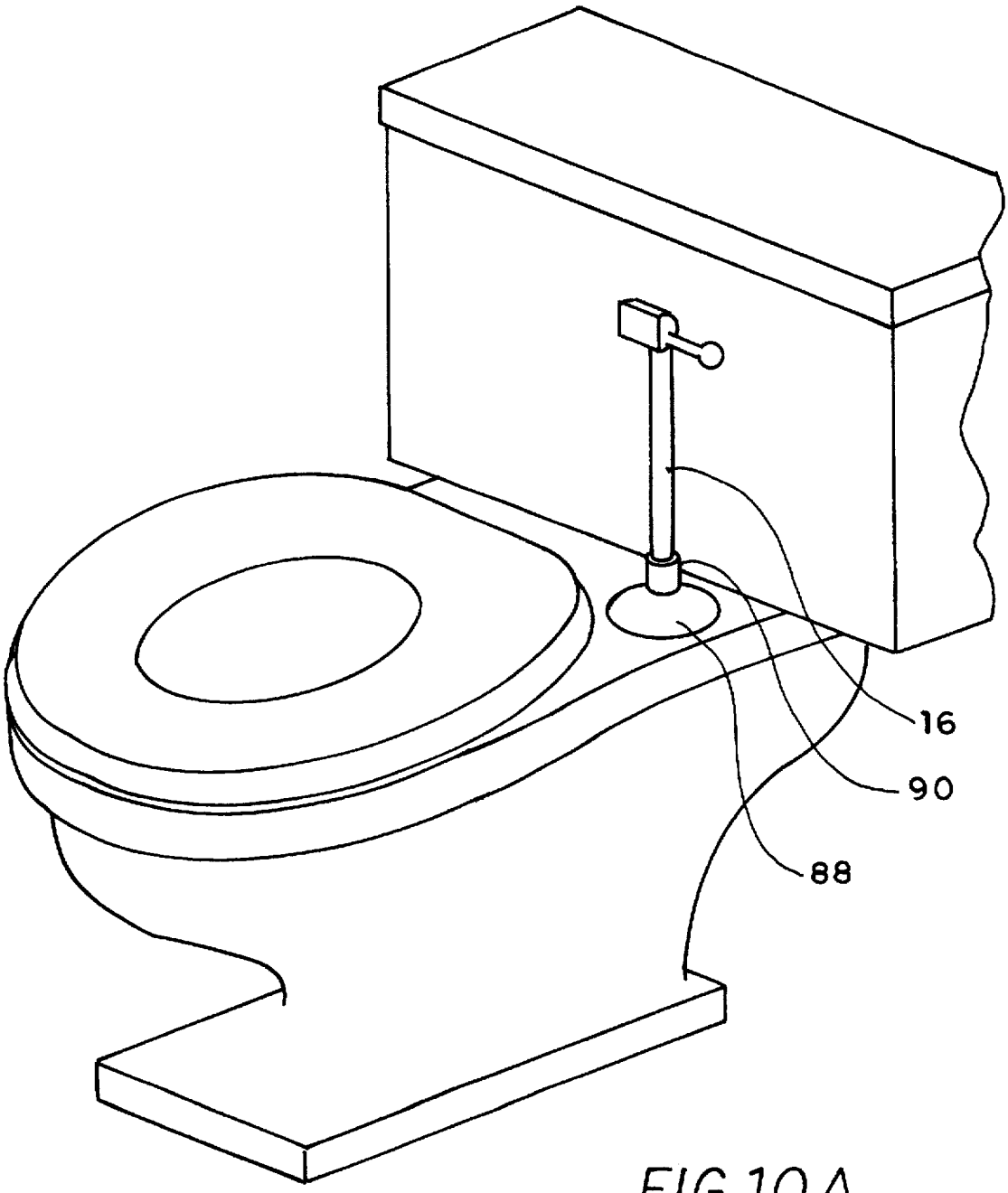
FIG. 10A is an environmental perspective view showing yet a further embodiment of the invention.

Referring to FIG. 10A, another embodiment of the invention is shown having a suction cup 88, rather than a housing, mounted to the toilet. A coil spring 90 is interposed between the suction cup 88 and lever 16. When lever 16 is articulated forward, spring 90 bends. After the user is finished with lever 16, spring 90 returns lever 16 back to an upright position. Spring 90 should be capable of holding lever 16 in the raised position. However, when lever 16 is articulated into the lowered position, forces created in spring 90 should not be sufficient to overcome the suction mounting between the suction cup 88 and the toilet.

Figure 10B:
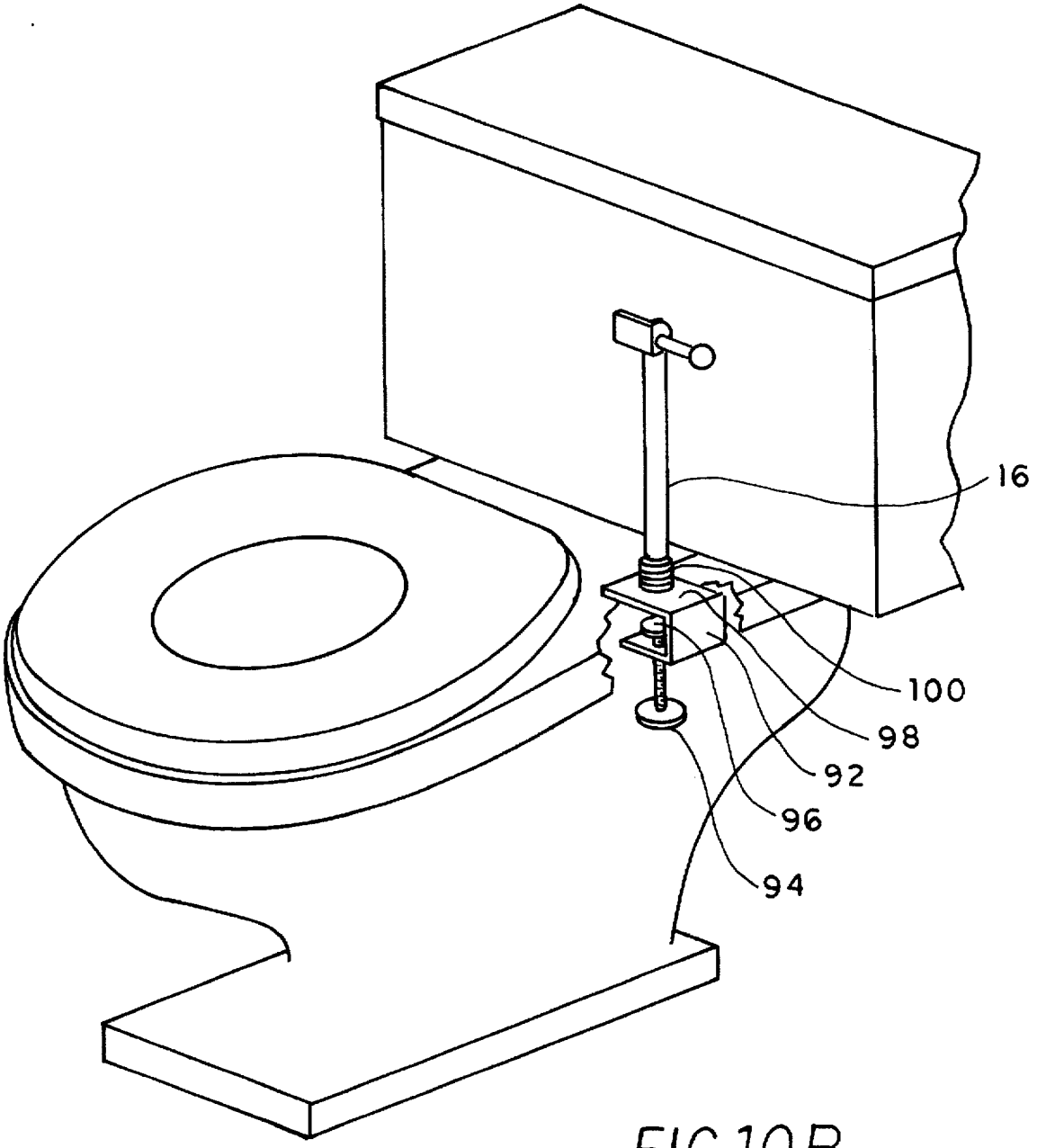
FIG. 10B is an environmental perspective view showing another embodiment of the invention.

Referring to figure 10B, another embodiment of the invention is shown having a bracket 92 which clamps onto the toilet. Rotating knob 94 screws and advances pad 96 against the toilet. Mounting pad, 98 and pad 96 cooperatively clamp the toilet to secure the invention thereto. Lever 16 is attached to mounting pad 98 with spring 100. Lever 16 is articulated similar to the way it is articulated in the embodiment depicted in FIG. 10*a*.

Referring to FIGS. 1 and 11, in operation, the user grasps and pulls down grip 18 to the lowered position shown in FIG. 1 proximate to the seat 24 or lid (not shown). The user flexes lever 16 away from the bowl, as shown in dashed lines, thus permitting insertion of tang 20 under the target element. Tang 20 and stabilizer 22 trap the target element providing the user with a secure means for lifting the target element to a raised position. The invention may be employed to raise the toilet seat 24 and lid (not shown) together, when the tang and stabilizer engage the toilet seat 24, or the toilet seat lid (not shown) only, when the tang and stabilizer engage the toilet seat lid (not shown) only. This alternate operation is accomplished without need of any structural change or modification whatsoever of the construction of either the invention or the toilet.

Figure 12:
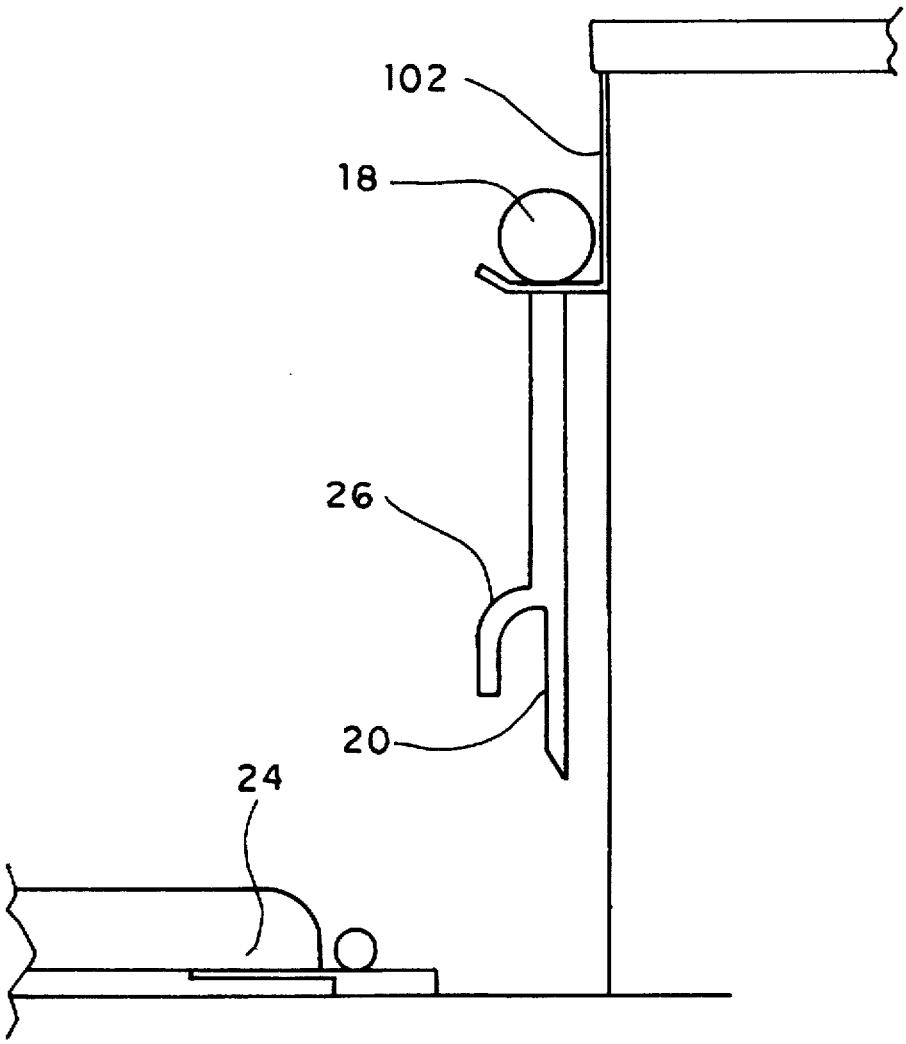
FIG. 12 is a fragmentary side elevational view of another embodiment of the invention.

Referring to FIG. 12, another embodiment of the invention is shown having no base-mounted housing or lever. Grip 18 includes only a tang 20 and stabilizer 26. Grip 18 is dimensioned and configured to be received in a bracket 102. Bracket 102 is hung over the side of the toilet tank. In operation, the user retrieves the invention from bracket 102, seizes the toilet seat between tang 20 and stabilizer 26, then, similar to a garden trowel, scoops the seat from the lowered into the raised position. The user may then return the invention for out-of-the-way storage in bracket 102.

The present invention is not intended to be limited to the embodiments described above, but to encompass any and all embodiments within the scope of the following claims.

I claim:

1. An apparatus to manipulate an element relative to a toilet, the toilet having a bowl, the bowl having a horizontal, annular lip, the lip having a front edge and a back edge; the element having a front edge and a rear edge, the rear edge being pivotally mounted to the rear edge of the lip of the bowl of the toilet with an element mount, the element being capable of free swinging movement in a rotational plane between a lowered position and a raised position, the element further having an upper surface and a lower surface, said apparatus comprising:

a base fixed relative to the toilet;

a housing having a bore defined therethrough having a central axis, said housing fixed to said base;

an axle having a central axis coincident with said central axis of said bore, said axle being received in said bore of said housing;

a lever having a first end and a second end, said first end demountably connected to said axle, said lever capable of swinging freely within a generally vertical, rotational plane about said axle;

a handle connected to said lever;

a tang connected to said second end of said lever, said tang dimensioned and configured to complementarily receive the lower surface of the element;

said tang including a stabilizer dimensioned and configured to complementarily receive the upper surface of the element;

wherein said lever, said tang and said stabilizer are configured to complementarily contact the element throughout articulation of the element between and including the lowered and raised position.

2. An apparatus according to claim 1, wherein said lever has a curved shape.

3. An apparatus according to claim 1, said housing and said lever frictionally interengaging and maintaining said lever in said raised position.

4. An apparatus according to claim 1, wherein said base has grooves dimensioned and configured to receive fasteners for securing the element to the toilet.

5. An apparatus according to claim 4, wherein said grooves are generally parallel.

6. An apparatus according to claim 1, wherein said base is integral with the element mount.

7. An apparatus according to claim 1, wherein said axle is integral with the element mount.

8. An apparatus according to claim 1, wherein said housing is integral with the element mount.

9. An apparatus according to claim 1, wherein said housing is integral with said base.

10. An apparatus according to claim 1, wherein said axle is integral with said lever.

11. An apparatus according to claim 1, wherein said tang is integral with said lever.

12. An apparatus according to claim 1, said housing having an annular groove within a plane orthogonal to said central axis of said bore in said housing for receiving said lever during articulation of the element.

13. An apparatus according to claim 1, said housing having a slot for receiving said axle, said slot also receiving an axle support, wherein said housing and said axle support cooperatively, complementarily and slidingly maintain said axle.

14. An apparatus according to claim 1, wherein said lever is fabricated from flexible material, wherein said lever may be urged away from the rotational plane of the element sufficient to permit detachable coupling of said tang and said stabilizer with the element.

15. An apparatus according to claim 1, further including a first spring having a first end and a second end, said first end fixed relative to said housing, said second end fixed relative said axle, said spring urging said lever to said raised, upright position.

16. An apparatus according to claim 15, wherein:

wherein said first spring is L-shaped, said first spring having a first leg and a second leg; and wherein said axle has a semi-circularly-shaped section profile for complementarily contacting said first leg of said first spring.

17. An apparatus according to claim 1, wherein said shaft includes a key and wherein said lever has a bore and slot for receiving said shaft and said key, respectively.

18. An apparatus according to claim 1, further including a second spring having a first end and a second end, said first end fixed relative to said base, said second end fixed relative to said lever, said spring biasing said lever toward said raised position.

19. An apparatus to manipulate an element relative to a toilet, the toilet having a bowl, the bowl having a horizontal, annular lip, the lip having a front edge and a back edge; the element having a front edge and a rear edge, the rear edge being pivotally mounted to the rear edge of the lip of the bowl of the toilet, the element being capable of free swinging movement in a rotational plane between a lowered position and a raised position, the element further having an upper surface and a lower surface, said apparatus comprising:

a base fixed relative to the toilet;

a housing having a bore defined therethrough having a central axis;

said housing further including an annular groove within a plane orthogonal to said central axis of said bore in said housing;

an axle having a central axis coincident with said central axis of said bore, said axle being received in said bore of said housing;

a lever having a first end and a second end, said first end demountably connected to said axle, said lever capable of swinging freely within a generally vertical, rotational plane about said axle;

a handle connected to said lever;

a tang connected to said second end of said lever, said tang dimensioned and configured to complementarily receive the lower surface of the element;

said tang including a stabilizer dimensioned and configured to complementarily receive the upper surface of the element;

wherein said lever, said tang and said stabilizer are configured to complementarily contact the element throughout articulation of the element between and including the lowered and raised position;

said base being integral with the element mount;

said lever being fabricated of flexible material, whereby said lever may be urged away from the rotational plane of the element sufficient to permit ready, detachable coupling of said tang and said stabilizer with the element.

20. An apparatus according to claim 19, said housing further comprising spring means urging said lever to a raised, upright position.

* * * * *